United States Patent [19]

Houston

[11] 4,009,542

[45] Mar. 1, 1977

[54] FOOTINGS AND FOUNDATIONS FOR BUILDING

[75] Inventor: Alvin J. Houston, Dollard des Ormeaux, Canada

[73] Assignee: Hutton Developments Ltd., Dollard des Ormeaux, Canada

[22] Filed: Feb. 25, 1976

[21] Appl. No.: 661,448

[52] U.S. Cl. ..... 52/73; 52/299

[51] Int. Cl.[2] ..... E04B 1/34; E02D 27/32

[58] Field of Search ..... 52/169, 73, 83, 292, 52/294, 299

[56] References Cited

UNITED STATES PATENTS

| | | | |
|---|---|---|---|
| 1,529,516 | 3/1925 | Thorne | 52/73 |
| 2,386,622 | 10/1945 | Marshall | 52/83 |
| 3,279,132 | 10/1966 | Slayter | 52/73 |

FOREIGN PATENTS OR APPLICATIONS

| | | | |
|---|---|---|---|
| 1,137,693 | 10/1962 | Germany | 52/169 |

*Primary Examiner*—John E. Murtagh
*Attorney, Agent, or Firm*—Alan Swabey & Co.

[57] ABSTRACT

The invention comprises a housing unit including at least a pair of elongated footing members spaced-apart and parallel, extending in one direction of the proposed building. A plurality of spaced-apart load supporting beam members are supported directly on said footings, the beam members extending parallel to each other and at right angles to the footings. The beam members extend in cantilever fashion beyond the edges of the footings and define the longitudinal edges of the housing unit to be supported. Longitudinal beams extend in cantilever fashion at right angles to the first beams to define lateral edges of the housing unit. A perimeter insulating skirt extends completely about the edges of the housing unit and at least contacts the surface on which the footing is supported to completely enclose the area surrounding the footings and to thermally insulate said area, the distance of said footings from the perimeter of said insulating skirt being such as to be free of ground freezing conditions in the immediate area of said footing if such freezing conditions occur in the environment of said housing unit. Structural uprights may also be provided on the beams to support substantially the loads of said housing unit directly onto said beams and therefore onto said footings.

8 Claims, 4 Drawing Figures

Fig. 1
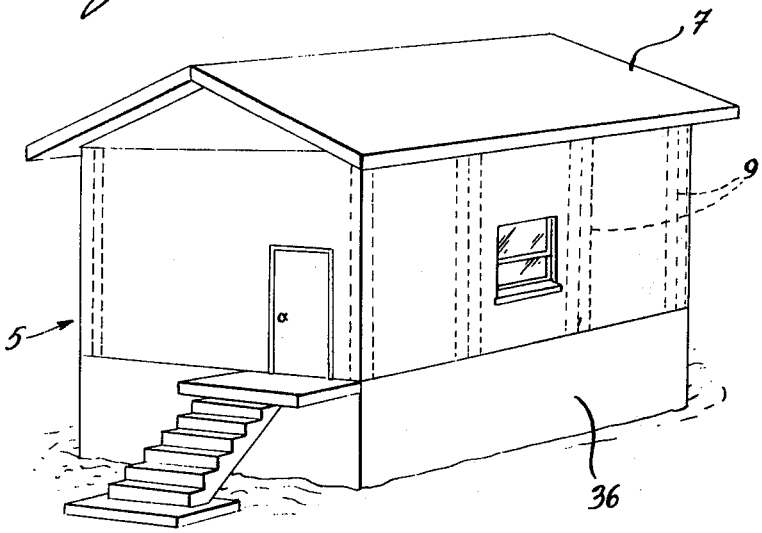
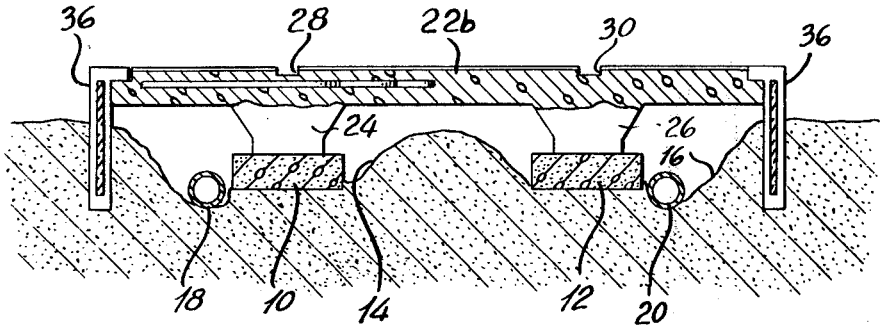
Fig. 3

FOOTINGS AND FOUNDATIONS FOR BUILDING

BACKGROUND OF THE INVENTION

1. Field of the Invention

The present invention relates to a structural frame and foundation for buildings.

2. Description of the Prior Art

Principal footings and foundations used in residential construction have, from early times, been vertical extensions of exterior load bearing walls. These extensions below grade vary from shallow 100% brick or concrete trench fill, such as found in traditional English construction, to simple wooden poles or stone columns used in more primitive lands, and the deep footings demanded by cold climates such as in Canada. Unstable soil due to the presence of moisture has also presented footing problems.

These traditional footings and foundations have provided a stable structure, but in relation to the load carried are usually over-designed. Their cost is becoming a significant factor in the overall cost of a house, primarily due to the large volume of material and hours of labour involved. For instance, a typical 8-inch basement wall of concrete having a total perimeter of 130 feet will have a load support capability of 12 million pounds depending on the soil conditions. On the other hand, a typical house, taking into consideration snow and wind loads, sitting on such a foundation, would have a total load of 200,000 pounds. Accordingly, such a conventional foundation is over-designed in a ratio of 60:1. On the other hand, even with this thickness of wall, not enough material is present for proper insulating requirements.

In the prior art, a number of patents have been found which show spaced-apart beam arrangements for footings. Examples of these are Italian Pat. No. 554,796, which issued in 1957, and U.S. Pat. No. 3,470,660, Van Der Lely et al., 1969. Both of these patents which use spaced-apart beams are not practical in areas of high thermal or climatic variations, such as in the tropics or northern regions. For instance, in northern regions, ground movements below the beams of the above-mentioned patents, caused by frost in the ground, would render the foundation system described impractical. In hot and dry climates, the open crawl space is a disadvantage in that heat will collect under the house and rodents will appreciate the cover. U.S. Pat. No. 3,468,094, Campbell, 1969, would not be necessarily affected by frost conditions since footings 27 are set below the frost line. However, the system described in the Campbell patent includes pretreatment of the ground as well as provisions of large deep footings 27 as well as the very large support beams 31. Again, it is believed that the Campbell patent foundations are over-designed, much in the same way as peripheral basements are. Further, the Campbell patent lacks stability in terms of resistance to wind.

In a published report entitled "Mass-Produced Foundations for Mass-Produced Houses," A Progress Report, September 1971, published by the Virginia Polytechnic Institute & State University, there is described a so-called bent beam and column with each composite beam and column including a beam section with a pair of columns extending from each end thereof at a slight angle outwardly and which are adapted to be inserted in the ground. A plurality of such composite beams and columns are spaced apart in parallel arrangement to support a small house. Again, no consideration is provided for extreme climatic conditions wherein frost may cause the columns of the bent beam to move and the house supported thereon to heave. This system also lacks stability in the sideways direction.

U.S. Pat. No. 3,543,459, Mills, 1970, shows a slab foundation construction having a peripheral damming skirt which prevents roots and water from attacking the slab. Once again, uninsulated slab foundations are not practical in northern regions since even with the skirt provided, frost might reach at least the peripheral areas of the ground underneath the slab causing the slab to heave.

The above-mentioned beam foundations and footings suffer structurally in terms of sideways stability. In very warm tropical climates, they also do not have the same benefit as peripheral foundations where such foundations act as insulating barriers to prevent overheating of the house by preventing the warm daytime air from circulating underneath the house.

SUMMARY OF THE INVENTION

It is an aim of the present invention to provide a stable foundation and footings as well as a prefabricated structural frame which require low costs relative to present foundation systems and are adapted for both northern regions as well as tropic areas.

It is a further aim of the present invention to provide thermal insulation for the area underneath the building in combination with the improved foundation and footing structure.

It is a further aim of the present invention to provide improved upright frames in combination with the footings and foundation and which might be provided with ducts for enhancing the circulation of heating or cooling air within the house.

A construction in accordance with the present invention includes at least a pair of elongated footing members spaced apart and parallel, extending in one direction of the proposed building, a plurality of spaced-apart load supporting beam members supported directly on said footings, the beam members extending parallel to each other and at right angles to the footings, the beam members extending in cantilever fashion beyond the edges of the footings and defining the longitudinal edges of the housing unit to be supported, longitudinal beams extending in cantilever fashion at right angles to the first beams to define lateral edges of the housing unit, a perimeter insulating skirt extending completely about the edges of the housing unit and at least contacting the surface on which the footing is supported to completely enclose the area surrounding the footings and to thermally insulate said area, the distance of said footings from the perimeter of said insulating skirt being such as to be free of ground freezing conditions in the immediate area of said footing if such freezing conditions occur in the environment of said housing unit.

In a further embodiment, structural uprights may also be provided on the beams to support substantially the loads of said housing unit directly onto said beams and therefore onto said footings. In a more specific embodiment of the present invention, ducting means can be provided in the beams and uprights and communicating with each other for the provision of air circulation throughout the house.

BRIEF DESCRIPTION OF THE DRAWINGS

Having thus generally described the nature of the invention, reference will now be made to the accompanying drawings, showing by way of illustration, a preferred embodiment thereof, and in which:

FIG. 1 is a perspective view of a typical housing unit embodying the present invention;

FIG. 3 is a vertical cross-section taken along the line 3—3 of FIG. 2; and

DESCRIPTION OF THE PREFERRED EMBODIMENTS

Figure 2:
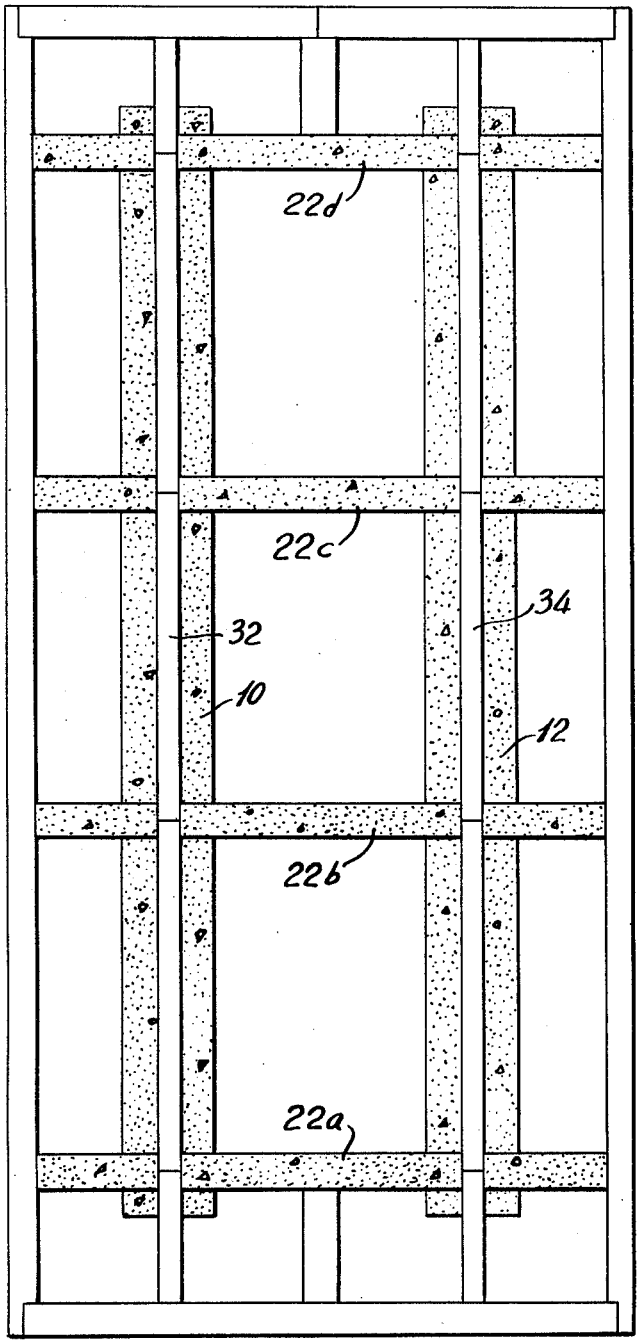
FIG. 2 is a top plan view of a typical frame and foundation and footing arrangement in accordance with the present invention.

Referring now to the drawings and especially to FIGS. 1 to 4, there is shown a house 5 having a roof 7 sitting on uprights 9.

Figure 4:
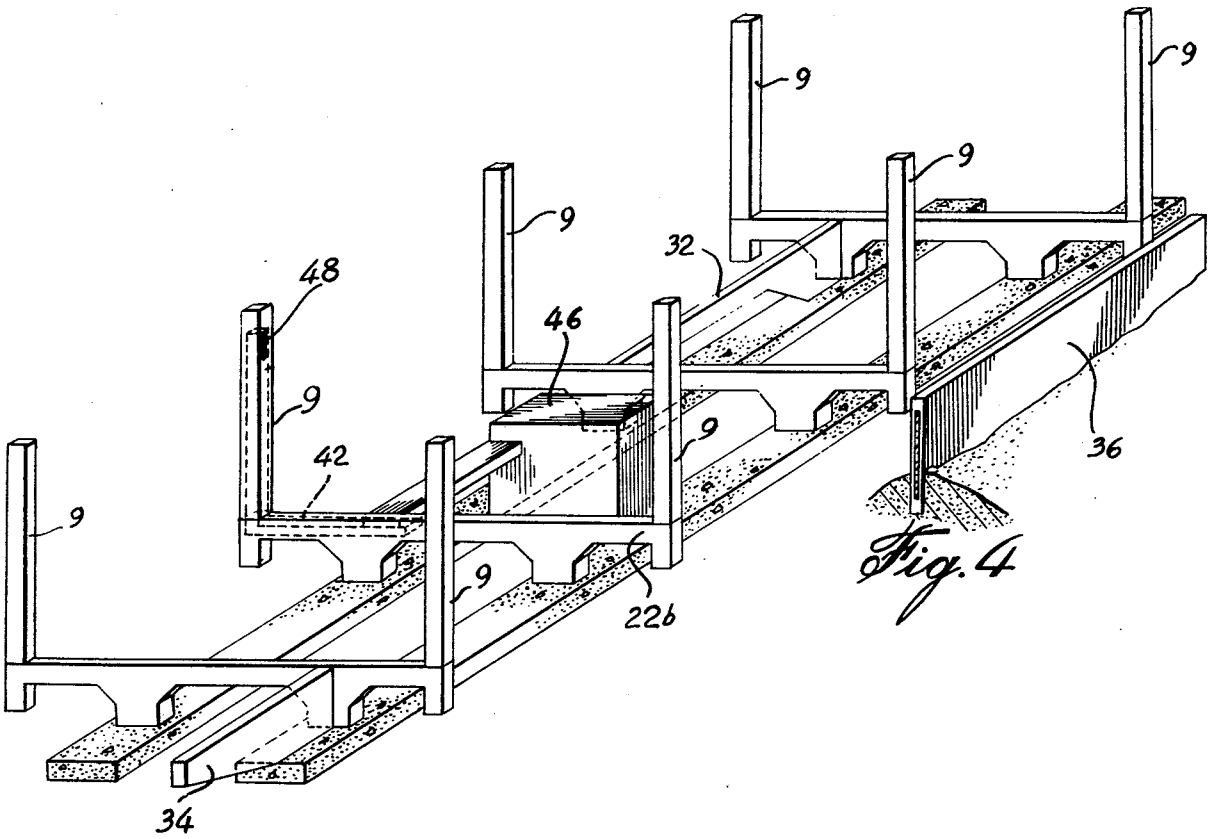
FIG. 4 is a perspective view of the frame and foundation and footing shown in FIGS. 2 and 3.

In FIGS. 2 and 3 as well as FIG. 4, there is shown elongated footing slabs 10 and 12 which can be precast but preferably poured in place after trenches 14 and 16 have been dug. Of course, the dimensions of the footing must relate the expected total load to the local soil conditions. Drainage tiles 18 and 20 are also provided in the trenches slightly below the level of the footings.

A plurality of laterally extending grade beams 22*a*, 22*b*, 22*c* and 22*d* are placed such that they are supported by the footings 10 and 12 and are spaced apart in parallel vertical planes along these footings. Each grade beam 22 includes a pair of downwardly extending support members 24 and 26 which sit on the footings 10 and 12 respectively. Keyways 28 and 30 are provided in each beam 22 for receiving long extending stabilizers 32 which stabilize the lateral beams 22. Cantilevered beams 34 are provided near the long ends to support the lateral edges of the house. The provision of the elongated footings and the fact that the beams are supported on these common elongated footings enhances the stability of the foundation especially in terms of sideways wind resistance.

Uprights 9 are normally located at the ends of the lateral beams 22, and as can be seen in the drawings, are on a cantilevered section of beams 22. Further uprights can be provided intermediate the beams 22. The uprights 9 will provide the main support for the roof of the house thereby supporting a major portion of the load. Accordingly, the walls, be they peripheral or partitioning, need be concerned only with insulation characteristics and need not be load bearing.

In an embodiment of the present invention, there is provided a hot air furnace 46, for instance, which can communicate with hollow passages within the beams 22 and the uprights 9, as shown in FIG. 4. The hot air from the furnace 46 could exit from the support uprights 9 by means of the outlet 48 in the upper region of a typical room. If the cold air register is near the floor of that room, there will be a flow of warm air downward as the air cools, within the room as opposed to the conventional dome effect of pushing hot air into the room from the floor level and pulling the cold air again at the floor level on the opposite side of the room.

In the production of the house, it is necessary to include a non-load-supporting perimeter skirt 36 about the perimeter edge of the house. This skirt would preferably be of high thermal insulating material and could be buried in the ground in a shallow trench which would be provided about the periphery of the house. The skirt 36 would prevent drastic climatic changes from affecting to any great extent the area of the ground below the floor of the house surrounding the footings. For instance, in cold climates, frost will not penetrate very far in the ground beyond the thermal insulating skirt 36, and in any case, the distance between the footings and the skirt would be calculated based on the projected area of freezing beyond the insulating skirt in any given geographical area. In the case of warmer climates, such as in the tropics, the skirt 36 will keep the crawl space below the house cool.

The provision of the footings in an area spaced from the perimeter of the house and the arrangement of cantilevered beams for supporting the house reduces the cost of construction of foundations greatly relative to conventional constructions. If the insulating skirt 36 were not provided about the perimeter of the house, the footings 10 and 12 would and could be affected by frost conditions in northern climates while the house would be subject to overheating problems as is now current in non-basement type housing in tropical areas. By providing the insulating skirt 36, such thermal extremes are avoided, and economic footings and foundations such as described can be provided in northern areas as well as in the warmer areas. The skirt 36 must have insulating characteristics, resist incidental physical abuse and stand up to climatic barrages such as sun, rain and snow. The skirt 36 must also have cosmetic value. The choice of materials depends on what is available locally. Two components can be used: a rigid component such as concrete, plywood or other panel products; and an insulating component such as foam plastics, wood-wool-cement aggregates, or foam lightweight concrete placed together to provide the correct thermal gradient.

I claim:

1. A housing unit comprising at least a pair of elongated footing members, spaced-apart and parallel, extending in one direction of a building, a plurality of spaced-apart beam members supported directly on said footings, the beam members extending parallel to each other and at right angles to the footings, the beam members extending in cantilevered fashion beyond the edges of the footings and defining the longitudinal edges of the housing unit to be supported, longitudinal beams extending in cantilevered fashion at right angles to the first beams to determine the lateral edges of the housing unit, load-supporting uprights provided on the cantilevered beams for supporting the load of said housing unit; the cantilevered beams and uprights being provided with integral communicating ducts which may be used for circulating heating or air-conditioning air throughout the housing unit.

2. A housing unit as defined in claim 1 wherein more than two cantilevered beams are provided on the footings, each beam having a downwardly extending support leg coinciding with the respective footing, and the beam having outwardly extending cantilevered sections for supporting and defining the edges of the housing unit.

3. A housing unit as defined in claim 2, wherein stabilizing members are provided between the plurality of cantilevered beams in order to stabilize the beams in the longitudinal direction.

4. A housing unit as defined in claim 1, wherein the housing unit includes roof trusses and said roof trusses are supported directly on the uprights provided on the cantilevered beams.

5. A housing unit as defined in claim 1, wherein the walls formed between the uprights are non-load-supporting and are selected on the basis of the insulating characteristics.

6. A housing unit as defined in claim 1, wherein a perimeter insulating skirt extends completely about the perimeter of the housing unit and at least contacting the ground to enclose the area surrounding the footings and to thermally insulate said area, the distance of said footings from the perimeter of said insulating skirt being such as to be free of ground freezing conditions in the immediate area of said footings if such freezing conditions occur in the environment of the housing unit.

7. A housing unit as defined in claim 6, wherein the skirt is rigid and has insulating characteristics.

8. A housing unit as defined in claim 6, wherein the skirt includes a relatively thin layer of concrete and insulation material laminated thereto.

* * * * *